US009462829B2

(12) United States Patent
Van Den Berg

(10) Patent No.: US 9,462,829 B2
(45) Date of Patent: Oct. 11, 2016

(54) FILTER FOR APPLICATION IN A CIGARETTE TUBE, ASSEMBLY, AND METHOD FOR MANUFACTURING A FILTER

(75) Inventor: Marinus Van Den Berg, Oud-Beijerland (NL)

(73) Assignee: Vandenberg Special Products B.V., Oud-Beijerland (NL)

( * ) Notice: Subject to any disclaimer, the term of this patent is extended or adjusted under 35 U.S.C. 154(b) by 1174 days.

(21) Appl. No.: 13/503,030

(22) PCT Filed: Oct. 19, 2010

(86) PCT No.: PCT/NL2010/050689
§ 371 (c)(1),
(2), (4) Date: Jun. 26, 2012

(87) PCT Pub. No.: WO2011/049438
PCT Pub. Date: Apr. 28, 2011

(65) Prior Publication Data

US 2012/0255568 A1 Oct. 11, 2012

(30) Foreign Application Priority Data

Oct. 22, 2009 (NL) ..... 2003688

(51) Int. Cl.
*A24D 3/04* (2006.01)

(52) U.S. Cl.
CPC ..... *A24D 3/04* (2013.01)

(58) Field of Classification Search
CPC ..... A24D 3/04; A47K 10/22; B31B 1/00; A47L 9/02; A45D 44/16
See application file for complete search history.

(56) References Cited

U.S. PATENT DOCUMENTS

| | | | | |
|---|---|---|---|---|
| 1,158,871 | A * | 11/1915 | Tomlin | G10K 11/08 138/166 |
| 2,908,933 | A * | 10/1959 | Todd, Jr. et al. | 15/414 |
| 2009/0151735 | A1* | 6/2009 | Pfanstiehl | A61F 11/08 128/864 |
| 2009/0250419 | A1* | 10/2009 | Szegfi | 211/85.5 |

FOREIGN PATENT DOCUMENTS

| | | |
|---|---|---|
| DE | 298 11 803 U1 | 10/1998 |
| EP | 1 837 292 A1 | 9/2007 |
| WO | 97/21362 | 6/1997 |
| WO | 03/020057 | 3/2003 |

OTHER PUBLICATIONS

DE 29811803 English Abstract, Oct. 1, 1998.*

(Continued)

*Primary Examiner* — Michael H Wilson
*Assistant Examiner* — Dionne Walls Mayes
(74) *Attorney, Agent, or Firm* — Renner, Otto, Boisselle & Sklar, LLP

(57) ABSTRACT

The invention relates to a filter for application in a cigarette tube. The invention also relates to an assembly of a cigarette tube and at least one filter according to the invention received in the cigarette tube. The invention further relates to a cigarette, in particular a "joint", based on such an assembly. The invention also relates to a blank for the purpose of manufacturing a filter according to the invention. The invention moreover relates to a method for manufacturing a filter according to the invention.

12 Claims, 3 Drawing Sheets

(56) References Cited

OTHER PUBLICATIONS

Figure 1A:
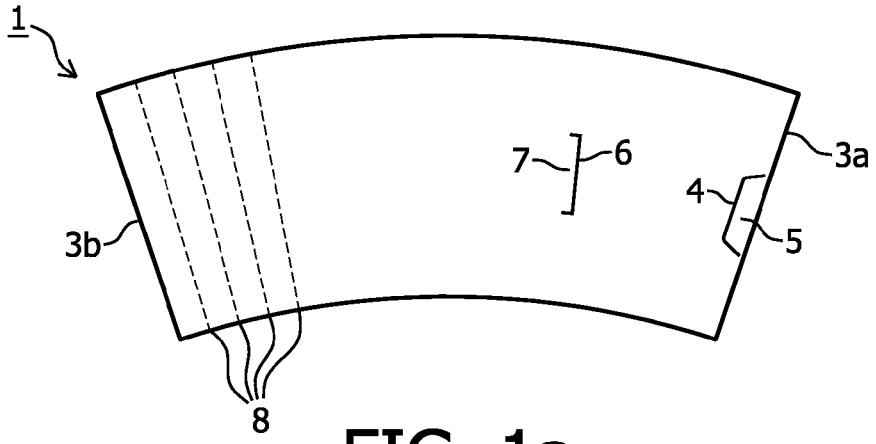

Mechanical English Translation of WO 03/020057, from http://translationportal.epo.org/emtp/translate/?ACTION=description-retrieval&COUNTRY=WO&ENGINE=google&FORMAT=docdb&KIND=A1&LOCALE=en_EP&NUMBER=03020057&OPS=ops.epo.org/3.1&SRCLANG=de&TRGLANG=en, printed on Nov. 23, 2015.*

International Search Report for corresponding International Application No. PCT/NL2010/050689 mailed Jan. 11, 2011.

Written Opinion for corresponding International Application No. PCT/NL2010/056893 mailed Jan. 11, 2011.

* cited by examiner

FILTER FOR APPLICATION IN A CIGARETTE TUBE, ASSEMBLY, AND METHOD FOR MANUFACTURING A FILTER

This application is a national phase of International Application No. PCT/NL2010/050689 filed Oct. 19, 2010 and published in the English language, which claims priority to NL 2003688 filed Oct. 22, 2009.

The invention relates to a filter for application in a cigarette tube. The invention also relates to an assembly of a cigarette tube and at least one filter according to the invention received in the cigarette tube. The invention further relates to a cigarette, in particular a "joint", based on such an assembly. The invention also relates to a blank for the purpose of manufacturing a filter according to the invention. The invention moreover relates to a method for manufacturing a filter according to the invention.

Known on the market are cigarette tubes using which a user can make cigarettes him/herself by filling the cigarette tubes with tobacco and possible additives. The cigarette tubes generally take a cylindrical form here in order to make conventional cylindrical cigarettes, or a conical form in order to make joints, wherein the conical cigarette is filled with tobacco and one or more mind-altering additives such as cannabis. The known cigarette tubes are generally manufactured mechanically from cigarette paper. If the pre-prepared cigarette tubes have not yet been provided with a filter, a user will then generally arrange a filter him/herself in the cigarette tube before it is filled with tobacco and possible additives. Particularly when conical cigarette tubes are applied, it is generally usual to manually arrange the filter, also referred to as tip, in the conical cigarette tube. The filter is usually formed here by a strip of paper rolled up by the user. The filter prevents tobacco and other coarser solid constituents arranged in the cigarette tube from being inhaled during smoking of the cigarette, while inhalation of smoke (and other gases) via the filter does however remain possible. The drawback of the known filter is that making the filter and subsequently positioning the filter in the cigarette tube is perceived as laborious and time-consuming.

An object of the invention is to provide a relatively user-friendly filter for application in a cigarette tube.

The invention provides for this purpose a filter of the type stated in the preamble, comprising: a channel structure formed by at least one deformed blank, and locking means for substantially fixing the blank in deformed state of the blank. Use of the locking means has the result that the blank, preferably formed by a rectangular or circle segment-shaped strip of (cigarette) paper, can already be pre-fixed mechanically or otherwise in the deformed state, whereby a user can in fact purchase a ready-to-use filter, this considerably facilitating and speeding up the preparation of a cigarette. It is also possible to envisage the user making the filter him/herself by deforming a blank to form the filtering channel structure, after which the relevant blank can be fixed in the deformed state using the locking means. Although a user will have to carry out the manual operation here of making the filter, an advantage for the user is that the locked filter can be arranged relatively easily in the cigarette tube, since unrolling and/or unfolding of the filter can be prevented as a result of the filter being locked, this enhancing the user-friendliness of placing the filter according to the invention in a cigarette tube. The channel structure of the filter is understood to mean that the blank is deformed such that one or more filter channels are created in the filter, whereby displacement of the smoke to be inhaled is however possible and whereby displacement of coarser (tobacco) particles is not possible. The blank can be at least partially or even completely rolled up. It is however also possible to envisage the blank being at least partially or even completely folded up. It is also possible to envisage a combination of the two variants. The locking means are generally of mechanical nature, whereby the use of chemical substances such as glue is not necessary. Application of chemical additives to enable locking of the filter is generally undesirable because of the health risks this may entail for the user during smoking of a cigarette which would comprise such a chemically locked filter.

The locking means preferably form an (integral) part of the blank, whereby the filter can be embodied in structurally relatively simple and inexpensive manner. It is moreover possible in this way to prevent the locking means being removed from the blank and possibly being lost, which would detract from the advantage of the filter according to the invention.

Because the deformed blank will usually tend to unroll and/or unfold as a result of the bias present in the blank, the locking means are preferably adapted to hold the deformed blank under bias. The advantage here is that use can also be made of the bias present in the blank by causing the locking means to exert an opposed locking bias on the blank, whereby the deformed state can be maintained. A self-locking mechanism can be obtained by causing the-locking means to act in a direction opposite to the direction-in which the blank tends to unfold and/or unroll.

The locking means will generally comprise at least one locking element and at least one counter-locking element positioned at a distance from the at least one locking element, wherein the at least one locking element and the at least one counter-locking element are adapted for mutual co-action. An adjustable locking of the filter can optionally be realized by applying a plurality of locking elements or counter-locking elements, which can be advantageous when flexibility in the effective dimensioning and/or shaping of the filter is desired. The at least one locking element and the at least one counter-locking element are preferably adapted to engage (hook into) each other to enable the deformed blank to be held under bias, wherein there is more preferably a self-locking mechanism as referred to in the foregoing. At least one locking element will generally be positioned on or at least close to an edge of the blank defining a longitudinal edge of the filter, whereby the filter can be locked relatively efficiently without protruding blank parts, preferably in a substantially cylindrical or a substantially conical (truncated cone-shaped) configuration. In an advantageous embodiment of the filter each locking element is partially bounded by a first incision in the blank forming a locking tongue, and each counter-locking element is partially bounded by a second incision in the blank forming a counter-locking tongue. The incisions can here be given a linear or non-linear form depending on a form of the associated (counter-) locking elements.

In an embodiment of the filter the filter comprises at least one central blank part situated within a volume enclosed by a peripheral blank part of the filter. This central blank part generally increases the fineness of the filter, whereby a plurality of channels can optionally be formed within the channel structure which are mutually separated by the central blank part of the filter. The central blank part of the filter comprises at least one concertina strip. A concertina strip is understood to mean a stepped streamer folded from multiple strips of material, in particular paper, and having a zigzag-shaped cross-section.

The invention also relates to an assembly of a cylindrical or conical cigarette tube, or a cigarette paper for manufacturing such a cigarette tube, and filter according to the invention for co-action with the cigarette tube. The filter is preferably received here as separate component, so without fixing means, in the cigarette tube. In an embodiment the filter connects substantially close-fittingly to an inner side of the cigarette tube, whereby no tobacco particles or other coarser solid constituents can be displaced between the filter and the inner side of the cigarette tube and so bypass the filter. In an embodiment variant of the assembly according to the invention it is possible to envisage a plurality of filters according to the invention being received in the cigarette tube. The filters will generally be positioned mutually in line here, but can also be oriented in parallel (side by side).

In addition, the invention relates to a cigarette, in particular a joint, comprising an assembly according to the invention.

The invention further relates to a blank for manufacturing a filter according to the invention. The blank preferably takes a rectangular form here for the purpose of manufacturing a cylindrical or conical filter, or takes a circle segment-shaped form for the purpose of manufacturing a conical filter. The blank preferably comprises at least one locking element and at least one counter-locking element positioned at a distance from the at least one locking element, wherein the at least one locking element and the at least one counter-locking element are adapted for mutual co-action. The blank here preferably comprises a plurality of fold lines (weakening lines) for the purpose of forming a concertina strip as central blank part of the filter. Further embodiment variants and advantages of the blank have already been described at length in the foregoing.

The invention moreover relates to a method for manufacturing a filter according to the invention on the basis of a blank according to the invention, comprising of: A) deforming at least a part of the blank to form a channel structure, and B) locking the channel structure in the deformed state of the blank by means of the coupling means. In an embodiment variant the blank is at least partially or even completely rolled up during step A), whereby the filter acquires a partial or complete spiralized configuration. It is also possible to envisage at least a part of the blank being folded during step A). When a folded central blank part and a rolled-up peripheral blank part are applied, the folded central blank part will then generally be realized first, after which the remaining blank part will be rolled up.

Figure 1B:
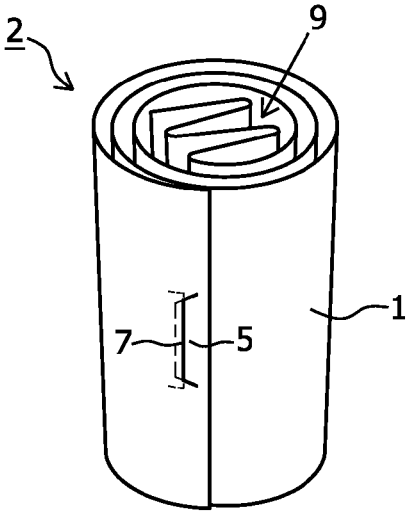
Figure 1C:
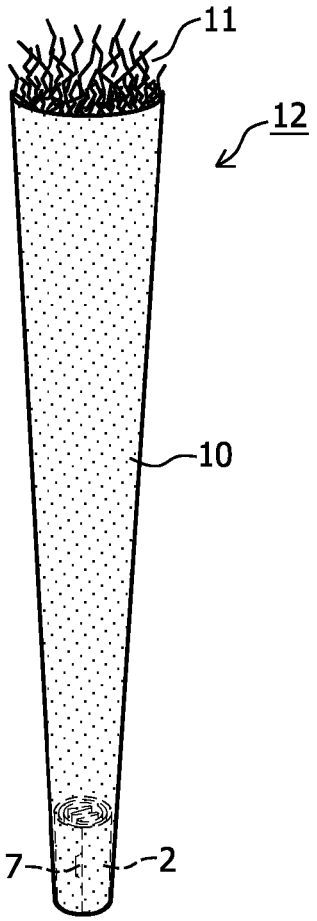
Figure 2:
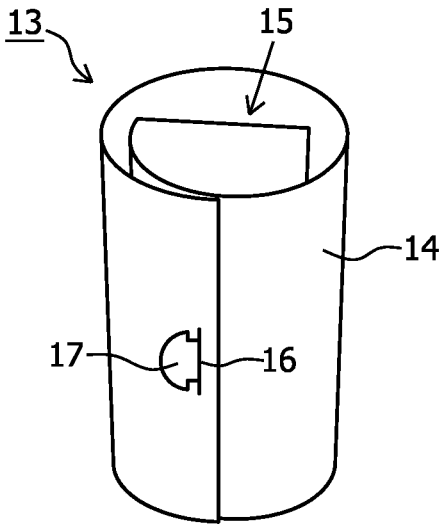
Figure 3:
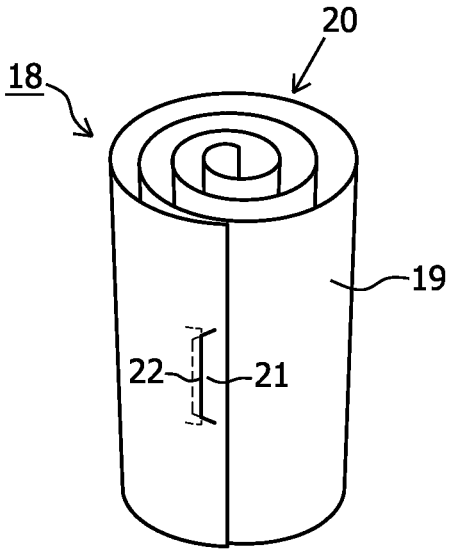
Figure 4:
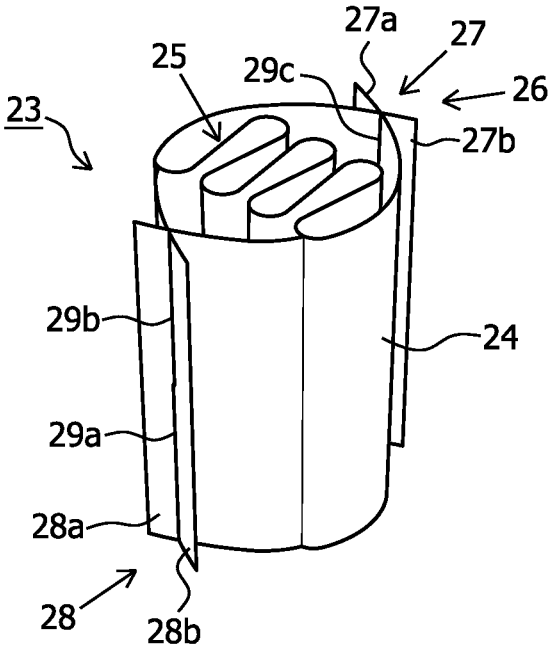
Figure 5:
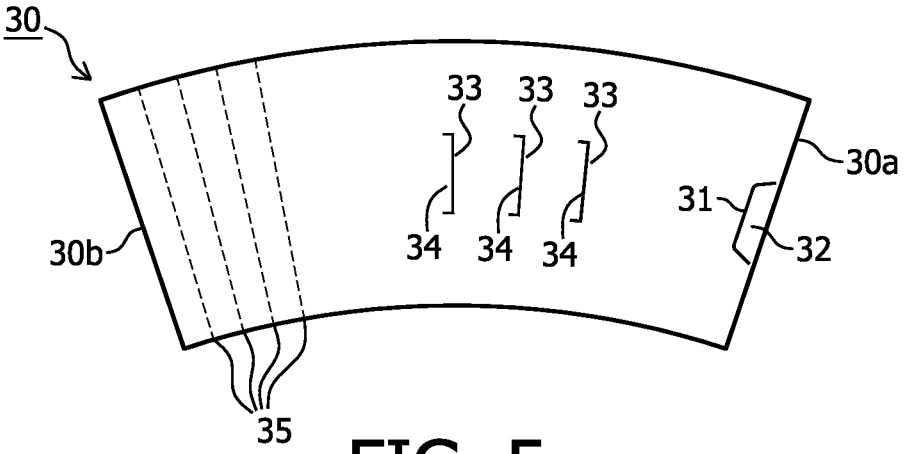

The invention will be elucidated on the basis of non-limitative exemplary embodiments as shown in the following figures. Herein:

FIG. 1*a* is a top view of a blank for manufacturing a filter according to the invention, FIG. 1*b* is a perspective view of a filter comprising the blank according to FIG. 1*a*, FIG. 1*c* is a perspective view of a cigarette comprising the filter according to FIG. 1*b*, FIG. 2 is a perspective view of another embodiment of a filter according to the invention, FIG. 3 is a perspective view of yet another embodiment of a filter according to the invention, FIG. 4 is a perspective view of yet another embodiment of a filter according to the invention, and FIG. 5 is a top view of an alternative blank for manufacturing a filter according to the invention.

FIG. 1*a* is a top view of a blank 1 for manufacturing a filter 2 (see FIG. 1*b*) according to the invention. Blank 1 takes a circle segment-shaped form and is provided on an end surface 3*a* with a locking tongue 5 bounded by a non-linear first incision 4, and a counter-locking tongue 7 bounded by a non-linear second incision 6. A plurality of fold lines 8 formed by interrupted perforations are arranged on an opposite end surface 3*b* of blank 1. A concertina strip 9 can be made in relatively simple manner by applying fold lines 8, after which the remaining blank part can be rolled around concertina strip 9. In the then obtained deformed state of blank 1 the locking tongue 5 and counter-locking tongue 7 can be hooked together in order to consolidate the shaping of the conically formed filter 2, and thereby complete filter 2. The locked filter 2 can then be arranged in a conical cigarette tube 10, after which cigarette tube 10 can be provided with tobacco 11 and possible additives (FIG. 1*c*), thus forming a cigarette 12. Filter 2 is not physically attached to cigarette tube 10, but preferably connects close-fittingly against an inner side of cigarette tube 10 in order to avoid as far as possible leakages via a space enclosed between filter 2 and cigarette tube 10. The formed concertina strip 9 in filter 2 impedes passage of tobacco 11 through filter 2, while smoke and other gases can displace freely through filter 2.

FIG. 2 is a perspective view of another embodiment of a filter 13 according to the invention. Filter 13 is cylindrical and comprises a channel structure 15 formed by a deformed rectangular blank 14 for passage of smoke to be inhaled by a user. Blank 14 is provided here with a slot 16 and a hook-like tongue 17, wherein in the shown situation tongue 17 is guided through slot 16 in order to thus stabilize the shaping of filter 13.

FIG. 3 is a perspective view of yet another embodiment of a filter 18 according to the invention. The spiralized filter 18 has a conical shape and is manufactured on the basis of a rolled-up circle segment-shaped blank 19 which encloses a channel structure 20. The spiralized conical form of filter 18 can be fixed by applying a locking tongue 21 forming an integral part of blank 19 and a counter-locking tongue 22 co-acting therewith.

FIG. 4 is a perspective view of yet another embodiment of a filter 23 according to the invention. Filter 23 is also based on a deformed blank 24 enclosing a channel structure 25. Blank 24 is here folded together in pleated manner and comprises a first locking mechanism 27 provided on an outer end 26 of blank 24 and a second locking mechanism 28 provided at a distance from first locking mechanism 27. Both locking mechanisms 27, 28 are based on having locking tongues 27*a*, 27*b*, 28*a*, 28*b* engage together, in this case by bounding each locking tongue 27*a*, 27*b*, 28*a*, 28*b* with an incision 29*a*, 29*b*, 29*c* in blank 24 which runs through to a longitudinal edge of blank 24. The shape of the biased filter 23 can be stabilized by applying the two locking mechanisms 27, 28.

FIG. 5 is a top view of an alternative blank 30 for manufacturing a filter according to the invention. Blank 30 takes a circle segment-shaped form and is provided on an end surface 30*a* with a locking tongue 32 bounded by a non-linear first incision 31, as well as three counter-locking tongues 34, each bounded by a non-linear second incision 33. A plurality of fold lines 35 formed by interrupted perforations are arranged at an opposite end surface 30*b* of blank 30. A predefined concertina strip can be made in relatively simple manner by applying fold lines 35, after which the remaining blank part can be rolled around the concertina strip. In the then obtained deformed state of blank 30 the locking tongue 32 can be placed selectively into co-action with one of the counter-locking tongues 34, depending on the desired dimensioning (diameter) of the filter, in order to consolidate the shaping of the conically formed filter.

It will be apparent that the invention is not limited to the exemplary embodiments shown and described here, but that within the scope of the appended claims innumerable variants are possible which will be self-evident to the skilled person in the field.

The invention claimed is:

1. Filter for application in a cigarette tube, comprising:

a channel structure formed by at least one deformable blank, and locking means for substantially fixing the blank in a deformed state, wherein the locking means form part of the blank, and wherein the locking means comprise at least one locking element and at least one counter-locking element positioned at a distance from the at least one locking element, wherein the at least one locking element and the at least one counter-locking element are adapted for mutual co-action, and wherein at least one locking element is positioned on or at least close to an edge of the blank defining a longitudinal edge of the filter, and wherein each locking element is partially bounded by a first incision in the blank forming a locking tongue, and each counter-locking element is partially bounded by a second incision in the blank forming a counter-locking tongue;

said channel structure configured to permit displacement of smoke to be inhaled.

2. Filter as claimed in claim 1, wherein the blank is at least partially rolled up.

3. Filter as claimed in claim 1, wherein the locking means are adapted to hold the deformed blank under bias.

4. Filter as claimed in claim 1, wherein the at least one locking element and the at least one counter-locking element are adapted to engage together to enable the deformed blank to be held under bias.

5. Filter as claimed in claim 1, wherein the filter comprises a central blank part situated within a volume enclosed by a peripheral blank part of the filter.

6. Filter as claimed in claim 5, wherein the central blank part of the filter comprises at least one concertina strip.

7. Filter as claimed in claim 1, wherein the filter takes a substantially cylindrical form.

8. Filter as claimed in claim 1, wherein the filter takes a substantially truncated conical form.

9. Assembly of a cigarette tube and at least one filter as claimed in claim 1 received in the cigarette tube.

10. Cigarette comprising an assembly as claimed in claim 9.

11. Method for manufacturing a filter as claimed in claim 1 using a blank, the method comprising of:

A) deforming at least a part of the blank to form a channel structure, and

B) locking the channel structure in the deformed state of the blank by means of the locking means.

12. Method as claimed in claim 11, wherein the blank is at least partially rolled up during step A).

* * * * *